United States Patent [19]

Bockoven

[11] 4,377,249

[45] Mar. 22, 1983

[54] BELT BUCKLE GUN HOLDER

[75] Inventor: Brian D. Bockoven, Dayton, Ohio

[73] Assignee: Michael A. Greenberg, Dayton, Ohio ; a part interest

[21] Appl. No.: 246,283

[22] Filed: Mar. 23, 1981

[51] Int. Cl.[3] ..... A45C 11/00

[52] U.S. Cl. ..... 224/163; 24/163 R; 42/1 J

[58] Field of Search ..... 224/163, 912; 46/1 E; D2/406; 24/163 R; 42/1 J, 1 K

[56] References Cited

U.S. PATENT DOCUMENTS 3,026,642 3/1962 Ryan ..... 46/1 E
4,260,087 4/1981 Leaver ..... 224/163

OTHER PUBLICATIONS

American Rifleman, Feb. 1954, pp. 26–27, "In My Arms Collection".
Playthings, Mar. 1960, vol. 58, No. 3, p. 24 "Panther Pistol".

*Primary Examiner*—Steven M. Pollard
*Assistant Examiner*—D. Voorhees
*Attorney, Agent, or Firm*—Reuben Wolk

[57] ABSTRACT

A belt buckle adapted to be used as a holder to retain a gun within the buckle. A cover which is attached to the buckle helps hold the gun in place and is released when the gun is to be withdrawn from its retained position.

30 Claims, 4 Drawing Figures

BELT BUCKLE GUN HOLDER

BACKGROUND OF THE INVENTION

It is a well-known fact that the United States of America is a nation of guns of all types. When the earliest settlers landed on our shores, guns were necessary to obtain food and to defend the settlers against hostile individuals. As our ancestors moved west, they expanded their use of firearms and invented new types of weapons and accessories. During the turbulent days of the western frontier, lawbreakers misused the easy availability of firearms, and communities found it increasingly necessary to appoint representatives to counteract lawlessness, often by their own use of guns.

Although those frontier days have gone, the criminal element has remained with us. Our law enforcement personnel must still rely on firearms to control criminal activities. Many police officers have found it prudent to carry various types of guns, including small, hidden revolvers or automatic pistols which may serve as back-up weapons. These are usually carried in pockets of the clothing, a practice which is less than satisfactory because the guns might not be easy to withdraw, may tend to catch in the clothing, or may accidentally discharge upon withdrawal. Police officers have long been aware of the need for some type of holder providing easy access but which would remain hidden or partially hidden. Such a holder should ideally be superior to a conventional shoulder holster or gun belt holster if it is to fulfill its function in holding a back-up gun.

SUMMARY OF THE INVENTION

My invention solves the above described problem of finding a convenient form of holder for back-up guns, particularly small guns. I accomplish this by means of a novel rigid holder which is an integral part of a belt buckle. The buckle has a configuration which makes it convenient to retain a revolver or an automatic pistol by the use of gun-retaining clips and a cover member. The cover is retained in place over the gun until the gun is to be drawn, at which point the cover is released so that the gun is free of restraint. Preferably, the general configuration of the buckle may conform to the shape of the gun as shown in the preferred embodiment disclosed herein. However, any convenient shape may be used. The gun illustrated is a revolver, and hence the buckle is shown to accommodate the cylinder; however if the gun were of the type referred to as an "automatic", a different configuration, probably without the cylinder opening, would be used. The cover member is shown as being hinged at the top, but could also be hinged at the bottom or side. Also, various types of cover release mechanisms could be used instead of the spring-loaded button which is illustrated.

The concept of utilizing a belt buckle as a rigid gun holder is believed to be novel. It has been known to utilize belt buckles as holders or containers for other objects, which have been designed to accommodate the specific article being retained. For example, U.S. Pat. No. 1,578,468, issued to Rankin, describes a belt buckle which is used as a match box, and has a hinged body which drops from the lid that is part of the buckle. Lesser et al, U.S. Pat. No. 3,088,234, refers to a buckle which has a hinged cover that may be opened to release a data sheet. Foster U.S. Pat. No. 3,927,492 is directed to a buckle having a receptacle for carrying credit cards, also having a hinged cover. Collins U.S. Pat. No. 4,096,979 refers to a knife blade which is an integral part of a belt buckle. Woodbury U.S. Pat. No. 4,113,157 utilizes a belt buckle which also serves as a coin receptacle, also having a hinged cover. None of the above patents, however, disclose a belt buckle which also serves as a holder in which a gun may be secured until it is to be drawn, with the structure so arranged as to permit easy withdrawal of the gun.

Other gun holding devices have been known such as shown in Wanee U.S. Pat. No. 1,046,912; which, however, does not suggest my novel construction nor adaptability to a belt buckle.

It is a principal feature of the invention to provide a belt buckle acting as a rigid holder for a gun.

It is a further feature of the invention to provide retaining means on the buckle to retain the gun.

Other features, details, and objects of the invention will be apparent from the embodiment shown, which is merely exemplary, as presented in the following specification, claims and drawings.

BRIEF DESCRIPTION OF THE DRAWINGS

The preferred embodiment of the invention is illustrated in the accompanying drawing figures, in which.

DESCRIPTION OF THE ILLUSTRATED EMBODIMENT

Figure 1:
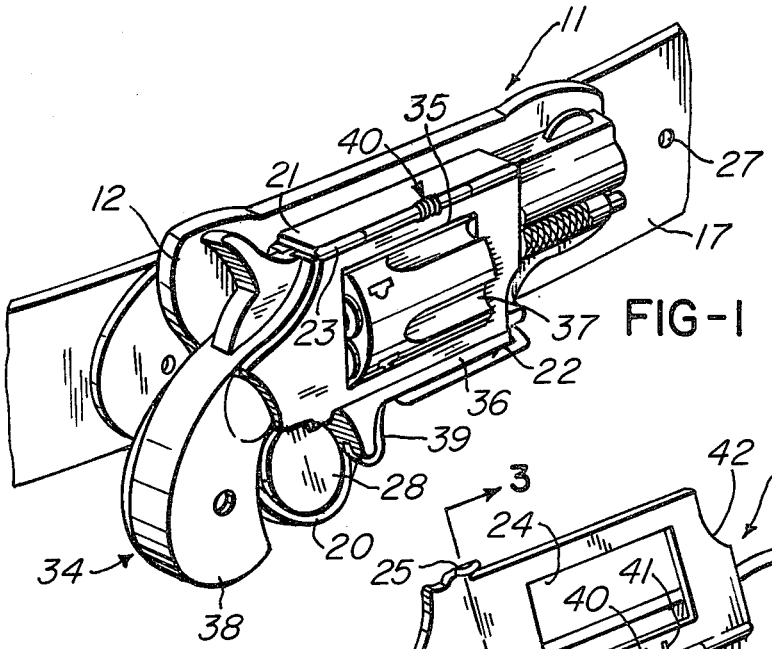
FIG. 1 is a perspective view of my novel belt buckle gun holder with the gun secured in place.

Referring now to the drawings, the belt buckle gun holder assembly is designated by reference numeral 11, having a rigid main body or supporting member 12, preferably made of metal, which has the general configuration of a gun with a central portion 13, a narrowed portion 14 similar in shape to a gun barrel located on one side of the central portion, and a downwardly extending portion 15 on the other side of the central portion, similar in shape to a gun handle. On the back side of the body 12 is a loop 16 adapted to be secured to one end of a belt 17. Also located on the back side of the body 12 is a tang 18, adapted to fit into a belt hole 27 when the belt is buckled. The central portion 13 of the body has an opening 19, shaped to receive the cylinder of the gun. At the lower end of portion 15 is a curved rib 20 which extends outwardly from the front face of the body, for a purpose to be later described. In general, the body or member 12 generally has a supporting area equal to a substantial projected area of the gun which it receives and retains.

Figure 2:
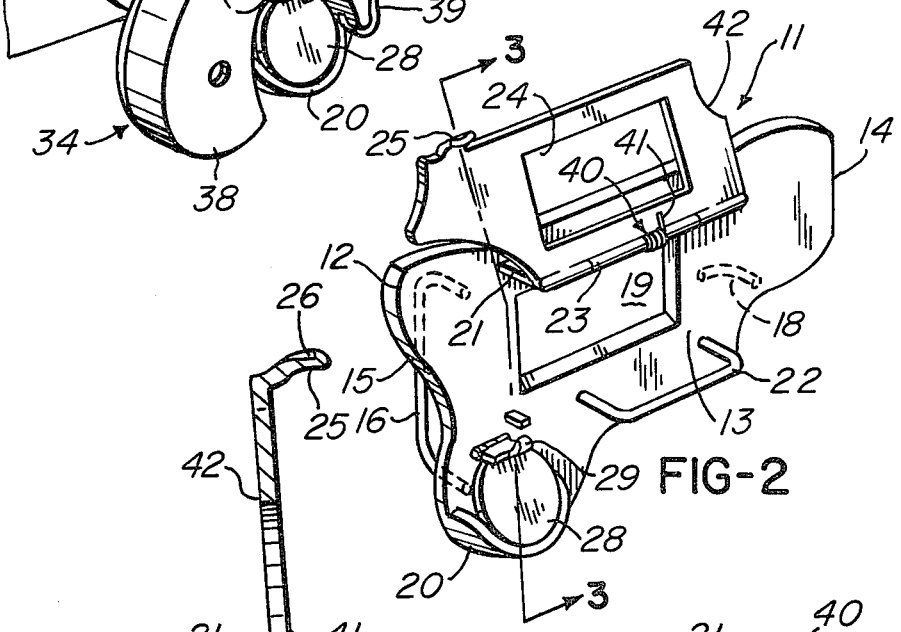
FIG. 2 is a perspective view of the gun holder with the securing cover raised, without the gun.
Figure 3:
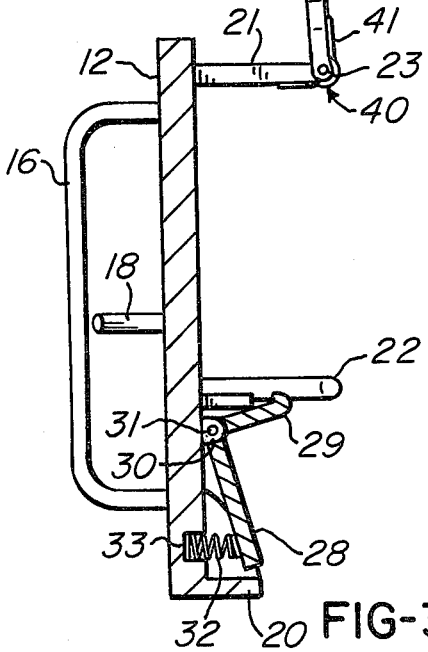
FIG. 3 is a sectional view of the device taken along lines 3—3 of FIG. 2.
Figure 4:
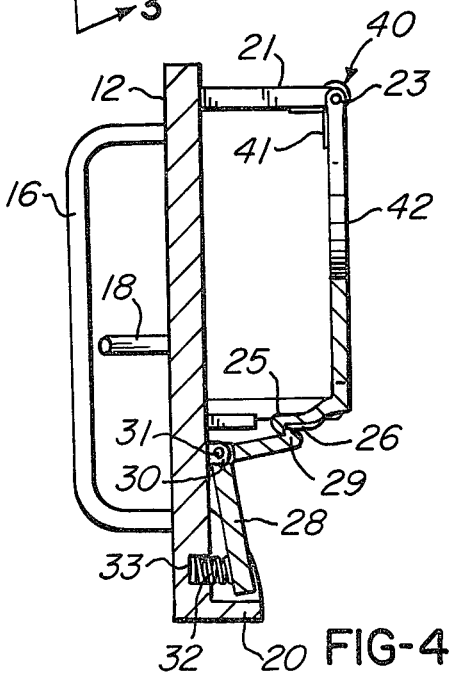
FIG. 4 is a view similar to FIG. 3, illustrating the cover in locked position.

Extending outwardly from the upper portion of the body 12 is an upper clip or plate 21, and extending parallel to this clip is a lower clip 22. The clip 22 is shown as a U-shaped rod, which is somewhat springy, but may be a solid plate similar to plate 21. A cover or door 42 is secured to the upper clip 21 by means of a hinge 23 to permit the cover to be closed as shown in FIGS. 1 and 4, or to be swung open, as shown in FIGS. 2 and 3. The cover has a central opening 24, shaped to receive one side of the gun cylinder in a similar manner to opening 19. The cover is held in its open position by means of a spring 40 which is mounted on the pins of the hinge, and has an end 41 bearing against the door. In order to secure the cover to the body in its normally closed position, a catch 25 extends outwardly from the cover, this catch consisting of a thin strip of material such as metal having a notch 26. Mounted on the lower portion of the body 12 is a release button 28 having a generally circular shape but with an offset upstanding leg 29 that fits within notch 26, as shown in FIG. 4. The button is mounted on a rib 30 which extends outwardly from the body, by means of a pivot pin 31. The button is in a normally locked position to retain the cover in a closed position; this is accomplished by the use of a spring 32 that is seated in a recess 33 of the body and bears against the inner surface of the button to bias the button into the normally locked position. The purpose of the rib 20, described above, is to act as a shield so that the button will not be inadvertently pressed.

OPERATION OF THE DEVICE

As described above, the belt buckle 11 is designed to be attached to a belt 17 in a conventional manner, with one end of the belt being passed through the loop 16 and secured to itself. After the belt has been pulled into a comfortable position, the tang 18 is inserted into a belt hole 27. This arrangement is merely one example, however, of how a buckle may be utilized in conjunction with a belt. The buckle may be worn, if desired, as a conventional one with the cover 42 closed. In addition, it is possible to wear the device on a belt which already has a buckle, simply by sliding the loop 16 over the buckle-less end of the belt and inserting the tang in another hole. It should also be noted that the device, rather than being worn around a conventional around-the-waist belt, may be worn on a shoulder strap, or any ornamental strap.

When the buckle is to be used as a holder for a gun, the cover 42 is opened, and a gun, designated here by reference numeral 34, is inserted therein. In the present showing, the gun is received and retained between the upper and lower clips 21 and 22 which contact the upper and lower portions 35 and 36 of the body of the gun. The clip 22 has enough elasticity or spring to help lock the body of the gun in place. The cylinder 37 of the gun fits within the opening 19 of the body 12, which also helps to retain the gun in place. The butt or handle 38 of the gun extends beyond the portion 15 of the body to enable the gun to be easily grasped. The cover 42 is swung closed, and is retained in closed position by the locking action of the leg 29 of the button 28, which fits into the notch 26 of the cover. The spring 32 bears against the button to assist in the locking action. The opening 24 of the cover fits over the other side of the cylinder 37 of the gun to provide additional locking action and provide clearance for the cover. The openings 19 and 24 thus surrounds opposite halves of the gun cylinder to securely hold the gun in place. In this position, the gun is securely held within the holder so that even strenuous activity by the wearer will not dislodge it.

When it is desired to withdraw the gun from the holder the button 28 is pressed with a finger, preferably the forefinger, while the gun butt or handle 38 is simultaneously grasped between the base of the forefinger and the thumb, as with any gun. Pressure of the button compresses the spring 32 and swings the leg 29 out of the notch 26 to release the cover 42. Pressure of the end 41 of the spring 40 causes the cover to fly open into the position shown in FIGS. 2 and 3 and move away from the body. The gun may be withdrawn by the handle and the forefinger is moved into position on the trigger 39, and is ready for instant use.

Although the belt buckle holder is illustrated as having a specific configuration, it can be varied to fit various types and sizes of hand guns. For example, if the gun were an "automatic" without a cylinder, the openings 19 and 24 could be eliminated, and the holster would be shaped to accomodate it. Other modifications may be made within the scope of the invention.

I claim:

1. A belt buckle adapted for use as a holder for a gun, comprising means for receiving a gun, said means also retaining said gun on said buckle, some of said means comprising a cover over said gun and being releasable to permit said gun to be withdrawn from said buckle.

2. The belt buckle of claim 1 in which said buckle includes a rigid main body, said receiving and retaining means being affixed to said body and contacting parts of said gun.

3. The belt buckle of claim 2 including hinge means on said body fastening one end of said cover to said body, and separate means on said body for retaining an opposite end of said cover over said gun.

4. The belt buckle of claim 3 in which said cover retaining means is operable to release said opposite end of said cover, a portion of said hinge means actuating said opposite ends away from said body upon release.

5. The belt buckle of claim 4 including biasing means on said body for placing said cover retaining means in a position which fastens said opposite end of said cover to said body.

6. The belt buckle of claim 5 in which said cover retaining means are actuated to overcome said biasing means to release said opposite end of said cover.

7. The belt buckle of claim 6 including means on said body for preventing accidental actuation of said cover retaining means.

8. The belt buckle of claim 1 in which said cover has an opening adapted to receive a portion of said gun.

9. The belt buckle of claim 1 including a main body having a peripheral outline equal to a substantial projected area of the retained gun, and means on said body for attachment to a belt.

10. The belt buckle of claim 9 in which said main body has an opening adapted to receive a portion of said gun.

11. The belt buckle of claim 10 including a cover mounted on said body and means for retaining said cover to cover said gun, said cover having an opening opposite the opening in said body, both of said openings cooperating to receive a portion of said gun.

12. The belt buckle of claim 1 comprising a main body having a general configuration of said gun, an opening in said body adapted to receive a portion of said gun, and means on said body for attachment to a belt; means on said main body contacting portions of said gun for retaining it against said body; a cover for said gun secured to said body, hinge means on said body securing one end of said cover and including means tending to hold said cover in an open position to uncover said gun; cover retaining means mounted on said body and securing an opposite end of said cover to said body in a closed position to cover said gun, biasing means on said body normally placing said cover retaining means in a position to retain said cover in closed position, said cover retaining means actuated to overcome said biasing means to release said cover to permit said cover to be located in its open position; and means on said body for preventing accidental actuation of said cover retaining means.

13. In combination, a rigid gun holder and gun, including means on said holder for receiving and retaining said gun, said holder comprising a main body, some of said means comprising a cover having at least two ends affixed at one end to said body and secured at an opposite end in a closed position over said gun.

14. The combination of claim 13 in which some of said means are releasable to permit said gun to be withdrawn from said holder.

15. The combination of claim 13 in which said holder has a peripheral outline equal to a substantial projected area of said gun.

16. The combination of claim 13, said retaining means being affixed to said body and gripping parts of said gun to retain it in place.

17. The combination of claim 13 including means on said body for releasing the opposite end of said cover from its closed position, and means on said body moving said opposite end from said body to uncover said gun.

18. The combination of claim 17 in which said gun has a handle and a cylinder, said main body and said cover having opposite openings receiving said cylinder and providing at least part of said gun retaining means.

19. The combination of claim 18 in which said cover releasing means is adjacent said gun handle to permit simultaneous grasping of said handle and actuation of said cover releasing means.

20. The combination of claim 18 in which said handle extends beyond said main body to facilitate withdrawal of said gun.

21. The combination of claim 18 including hinge means mounted on said body and said cover to place said cover in either open or closed position.

22. A gun holder having a rigid construction, comprising integral means for receiving said gun, said means also retaining said gun in said holder, some of said receiving and retaining means comprising a cover over said gun.

23. The gun holder of claim 22 in which said holder comprises a principal gun supporting member, said member having a peripheral outline equal to a substantial projected area of said gun.

24. The gun holder of claim 23 adapted for mounting on a belt, including means on said member for mounting said holder on said belt.

25. The gun holder of claim 22 in which said cover has opposite ends, one of said ends being secured to said member and the other of said ends being releasably secured to said member, and means for releasing said other end to uncover said gun.

26. In combination, a gun holder and belt, said gun holder having a principal gun supporting member of rigid construction, said member having means for mounting said holder on said belt, said member also having integral means for receiving and retaining a gun in said holder, some of said receiving and retaining means comprising a cover over said gun and being releasable to permit said gun to be withdrawn from said holder.

27. The combination of claim 26 in which said cover has an opening adapted to receive a portion of said gun.

28. The combination of claim 26 including hinge means on said principal gun supporting member fastening one end of said cover to said body, and separate means on said principal gun supporting member for retaining an opposite end of said cover on said gun.

29. The combination of claim 28 in which said cover retaining means is operable to release said opposite end of said cover, a portion of said hinge means actuating said opposite ends away from said body upon release.

30. The combination of claim 26 in which said principal gun supporting member has a peripheral outline equal to a substantial projected area of the retained gun.

* * * * *